US006234238B1

(12) United States Patent
Koyama et al.

(10) Patent No.: US 6,234,238 B1
(45) Date of Patent: May 22, 2001

(54) ALUMINUM-ALLOY HEAT EXCHANGER

(75) Inventors: Sachio Koyama; Toru Takai, both of Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 09/553,947

(22) Filed: Apr. 21, 2000

(30) Foreign Application Priority Data

Apr. 23, 1999 (JP) ..... 11-116800

(51) Int. Cl.[7] ..... F28F 9/02; F28F 19/06

(52) U.S. Cl. ..... 165/78; 165/133; 165/134.1; 165/174; 165/175; 165/176

(58) Field of Search ..... 165/134.1, 173, 165/78, 174, 133, 175, 153

(56) References Cited

U.S. PATENT DOCUMENTS 5,097,900 * 3/1992 Yamaguchi ..... 165/174
5,209,292 * 5/1993 Arneson et al. ..... 165/176
5,582,239 12/1996 Tsunoda et al. .
5,607,012 * 3/1997 Buchanan et al. ..... 165/173
5,979,542 * 11/1999 Inoue et al. ..... 165/133
6,068,050 * 5/2000 Ghiani ..... 165/174

FOREIGN PATENT DOCUMENTS 62-70283 5/1987 (JP) .
4-353397 * 12/1992 (JP) ..... 165/176
7-280488 10/1995 (JP) .
8-327279 12/1996 (JP) .

* cited by examiner

*Primary Examiner*—Leonard Leo
(74) *Attorney, Agent, or Firm*—Foley & Lardner

(57) ABSTRACT

Tanks are respectively structured such that seat plates are combined with tank main bodies, and the two end openings thereof are respectively closed by end plates. The direction in which the end plates are combined with the seat plate and tank main body is defined in an only-one-meaning manner in accordance with the engagement between engagement projecting pieces and engagement holes. The seat plates and end plate are respectively clad members structured such that brazing material is cladded only on the outer surface side of the tanks.

10 Claims, 11 Drawing Sheets

ALUMINUM-ALLOY HEAT EXCHANGER

BACKGROUND OF THE INVENTION

1. Field of the Invention

The present invention relates to a heat exchanger made of aluminum alloy used as a heater core which is incorporated into an air conditioning apparatus for a car to heat the air that is used to condition the air in the interior of the car.

The present application is based on Japanese Patent Application No. Hei. 11-116800, which is incorporated herein by reference.

2. Description of the Related Art

Conventionally, it has been widely known that a tank, a heat transmission tube and a fin which are used to form a heater core are respectively made of plate members which are formed of aluminum alloy. Also, of the above three component members, in the tank, there is employed a structure in which the tank is composed of a combination of a seat plate and a tank main body respectively produced by enforcing plastic working such as press working on their respective mother or blank plate members made of aluminum alloy; that is, conventionally, this tank structure is also widely known, as disclosed in, for example, Japanese Patent Publication Nos. Hei. 7-280488, Hei. 7-305990, Hei. 8-327279, and Japanese Utility Model publication Sho. No. 62-70283.

Of the aluminum-alloy heat exchangers respectively disclosed in the above-cited publications, the aluminum-alloy heat exchangers especially disclosed in Japanese Patent Publication No. Hei. 8-327279 and Japanese Utility Model Publication No. Sho. 62-70283 respectively employ the following structure. In the outer peripheral edges of the tank main body and seat plate, there are formed hanging walls or vertical walls so as to extend over the whole periphery of the present outer peripheral edges, and the thus formed tank main body and seat plate are combined together in a wafer cake. In the case of such structure, however, when the plate members made of aluminum alloy, that is, the mother or raw members are deformed plastically to thereby form the above-mentioned tank main body and seat plate, there is required a relatively large force. This increases the size of the facilities that are used to execute press working, which in turn increases the cost of the facilities and thus makes it difficult to reduce the cost of the aluminum-alloy heat exchanger. Also, in order to be able to change heat exchange performance, when trying to obtain aluminum-alloy heat exchangers having different width dimensions, it is necessary to change a press mold itself to an entirely different one, which leads to an increase in the cost of the product. In the case of production of a large kinds of aluminum-alloy heat exchangers, the cost of the products becomes especially high.

On the other hand, in the aluminum-alloy heat exchangers respectively disclosed in Japanese Patent Publication Nos. Hei. 7-280488 and Hei. 7-305990 of Heisei, a tank main body and a seat plate respectively formed in a gutter shape are combined together to form a tubular-shaped member, and two openings formed at the two ends of the tubular-shaped member are closed by end plates which are produced separately from the tank main body and seat plate. In the case of this structure, there is necessary a small force when the plate members made of aluminum alloy used as the blank members are deformed plastically to thereby form the above-mentioned tank main body and seat plate. Thanks to this, when the plastic deformation is executed by press working, it is possible to use the facilities that are small in capacity and size and it is also possible to work the plate members consecutively by press working, which can reduce the cost of the facilities and thus can reduce the cost of the aluminum-alloy heat exchangers. Further, since the lengths of the tank main body and seat plate can be adjusted easily, even when producing aluminum-alloy heat exchangers different in the width dimension thereof, the press mold as it is can be used. That is, even in the case of production of a large kinds of aluminum-alloy heat exchangers, an increase in the cost of the products can be controlled down to a low level.

However, in the above-mentioned conventional aluminum-alloy heat exchangers respectively disclosed in Japanese Patent Publication Nos. Hei. 7-280488 and Hei. 7-305990 of Heisei, no account is taken of the followings: that is, how to enhance the efficiency of the assembling or combining operation and how to secure sufficient corrosion resistance. Specifically, referring to the enhancement in the efficiency of the assembling operation, in the conventional aluminum-alloy heat exchangers respectively disclosed in the above-mentioned publications, no restrictions are placed on the assembling direction of the end plates with respect to the tank main body and seat plate. Therefore, the end plates can be assembled to the tank main body and seat plate in any direction.

On the other hand, generally, an aluminum-alloy heat exchanger is structured by connecting together the respective component members thereof by brazing. Here, brazing material used for the brazing connection is previously applied (clad) on the surfaces of the respective component members. That is, each of the component members is made of a clad member which is composed of core material consisting of aluminum alloy having a high melting point and brazing material consisting of aluminum alloy having a low melting point cladded on the surface of the core material. And, in a state where the respective component members are assembled together, they are heated in a heating furnace up to a temperature slightly higher than the melting point of the brazing material to thereby melt the brazing material, so that the mutually adjoining component members can be connected together by brazing.

Because the brazing material contains a large quantity of Si, it is not sufficiently resistant against corrosion and, especially when the brazing material touches corrosive fluid, so called pitting is easy to occur in which the corrosion of the brazing material will progress locally in the thickness direction thereof. In case where the aluminum-alloy heat exchanger is used as a heater core, the coolant of an engine flows in the interior portion of the tank; and, since the coolant contains iron ions and copper ions, the coolant act as the corrosive fluid with respect to the aluminum alloy. For this reason, it is necessary to avoid positioning the surface of the end plate with the brazing material cladded thereon on the inner surface side of the tank. However, in the case of the aluminum-alloy heat exchangers respectively disclosed in the above-cited publications, since the end plate can be assembled in any direction, unless special account is taken of the assembling direction of the end plate in the assembling operation, there is a possibility that the end plate can be positioned on the inner surface side of the tank. Therefore, when trying to secure sufficient durability in the aluminum-alloy heat exchanger, the operation to assemble together the respective component members provides a poor efficiency, which increases the cost of the aluminum-alloy heat exchanger.

SUMMARY OF THE INVENTION

The present invention aims at eliminating the above-mentioned drawbacks found in the conventional aluminum-alloy heat exchangers. Accordingly, it is an object of the invention to provide an aluminum-alloy heat exchanger which has excellent durability and can be produced at an inexpensive cost.

In attaining the above object, according to the invention, there is provided an aluminum-alloy heat exchanger which, similarly to a conventionally widely known aluminum-alloy heat exchanger, comprises: a pair of tanks each made of a plate member formed of aluminum alloy, the two tanks being respectively disposed spaced from each other; a plurality of heat transmission tubes each made of a plate member formed of aluminum alloy, the heat transmission tubes respectively having their respective two end openings communicating with the interior portions of the two tanks with their end portions inserted through holes formed in the mutually opposed inner walls of part of the two tanks; and, a plurality of fins each made of a plate member formed of aluminum alloy, the fins being respectively interposed between the mutually adjoining ones of the heat transmission tubes.

Especially, in the aluminum-alloy heat exchanger of the invention, each of the two tanks is composed of a seat plate, a tank main body, and two end plates. Of these component members, the seat plate is structured such that the two side edges of a base plate portion serving as the above-mentioned inner walls are bent in the opposite direction to the heat transmission tubes to thereby provide a pair of bent wall portions. Also, the tank main body is structured such that the two side edges of a top plate portion opposed to and spaced from the base plate portion are bent on the heat transmission tubes side to thereby provide a pair of side wall portions. And, the two end plates are structured such that, in a state where the seat plate and tank main body are combined together, their respective outer peripheral edges are contacted with the inner surfaces of the base plate portion, bent wall portions, top plate portion and side plate portions.

Further, engagement projecting pieces are provided on the portions of part of the peripheral edges of the end plates that are disposed opposed to the top plate portion, and engagement holes for engagement with the engagement projecting portions are formed in part of the top plate portion. And, the engagement projecting portions and engagement holes are formed at positions shifted from the central portions of the two tanks in the width direction thereof to thereby define the assembling direction of the front and back surfaces of the end plates with respect to the tanks in an only-one-meaning manner.

According to the aluminum-alloy heat exchanger of the invention structured in the above-mentioned manner, there can be employed a structure which can facilitate the working of the tank main bodies and seat plates forming the tanks, and the brazing material cladded on one surface of each end plate can be positively positioned on the outer surface side of the tank. Thanks to this, it is possible to realize an aluminum-alloy heat exchanger which not only has sufficient durability but also does not increase the cost of the facilities for working the component members and can be thereby manufactured at a low cost.

Features and advantages of the invention will be evident from the following detailed description of the preferred embodiments described in conjunction with the attached drawings.

DETAILED DESCRIPTION OF THE PREFERRED EMBODIMENTS

Figure 1:
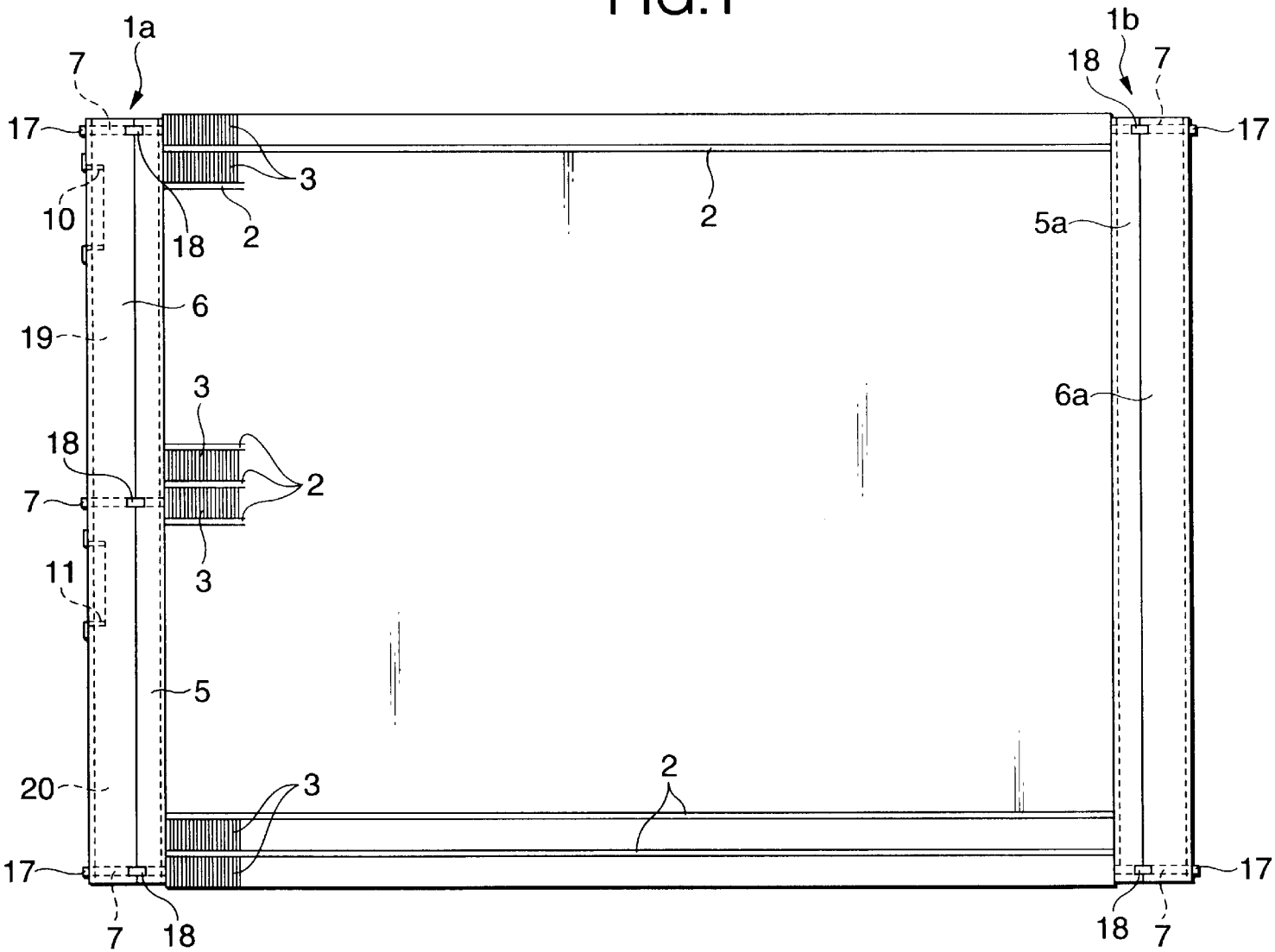
FIG. 1 is a front view of a first embodiment of an aluminum-alloy heat exchanger according to the invention.
Figure 2:
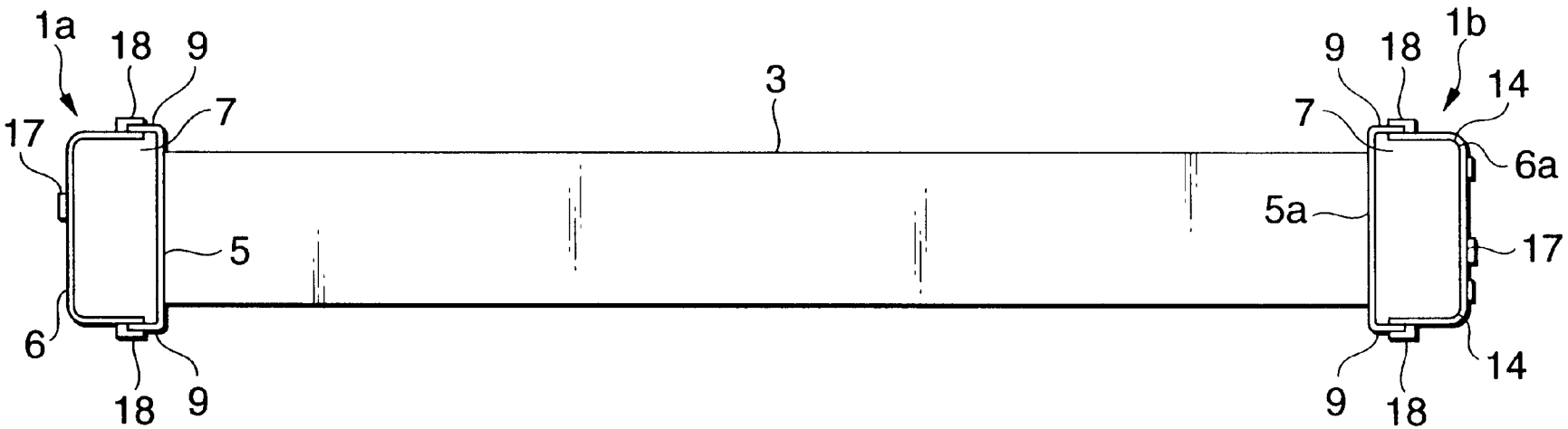
FIG. 2 is a plan view of the first embodiment.
Figure 3:
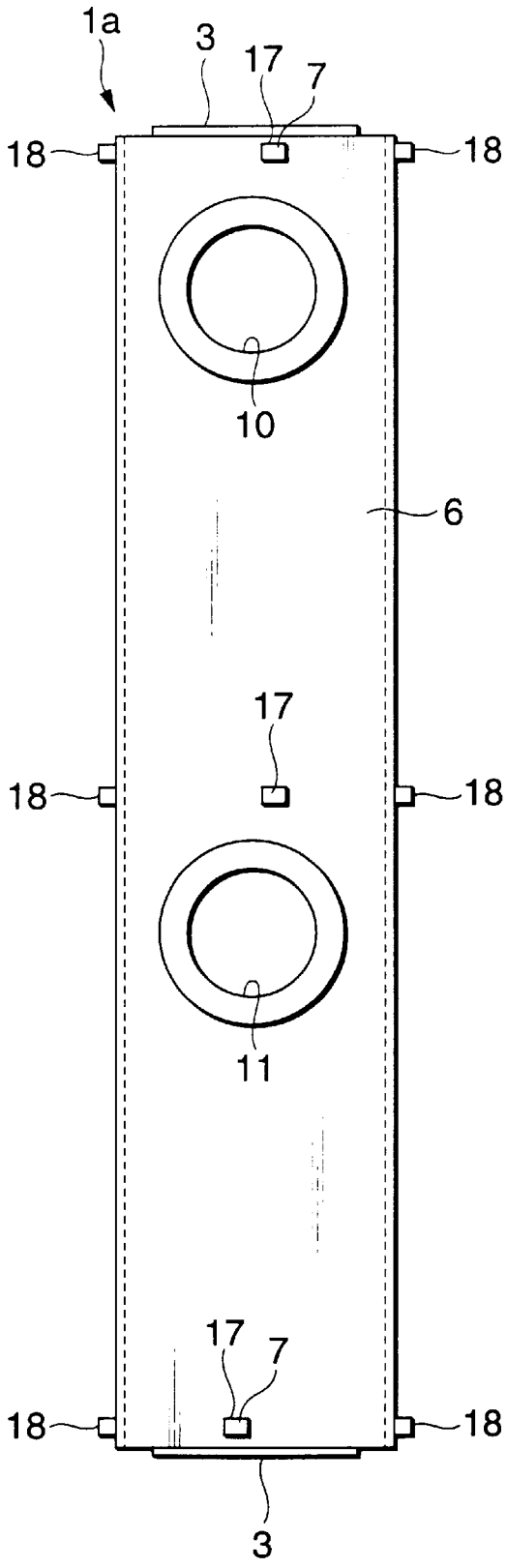
FIG. 3 is a side view of the first embodiment, when it is viewed from the left in FIG. 1.

Now, FIGS. 1 to 11 respectively show a first embodiment of an aluminum-alloy heat exchanger according to the invention. An aluminum-alloy heat exchanger according to the invention, as shown in FIGS. 1 to 3, comprises a pair of tanks 1*a*, 1*b*, a plurality of heat transmission tubes 2, 2, and a plurality of fins 3, 3. Of these component members, the tanks 1*a* and 1*b* are each made of a plate member formed of aluminum alloy and are respectively disposed spaced apart from each other. Also, the heat transmission tubes 2, 2 are each formed of aluminum alloy into a flat tube having a section which is formed in an elliptical shape. The two end portions of each of the heat transmission tubes 2, 2 are respectively inserted into through holes 4, 4 (see FIGS. 4 to 6) formed in the mutually opposed inner walls of part of the two tanks 1*a* and 1*b* to thereby connect the inner peripheral edges of these through holes 4, 4 to the outer peripheral surfaces of the two end portions of the respective heat transmission tubes 2, 2 by brazing. Therefore, openings formed in the two end portions of the heat transmission tubes 2, 2 are respectively allowed to communicate with the interior portions of the tanks 1*a* and 1*b*.

Also, the fins 3, 3 are respectively made of corrugated members each of which is obtained by working a band-shaped plate member formed of aluminum alloy into a corrugated shape; and, the fins 3, 3 are respectively interposed between the mutually adjoining heat transmission tubes 2, 2 as well as are disposed on the outside of the outer-most heat transmission tubes 2, 2 to thereby connect their contact portions with their associated heat transmission tubes 2, 2 by brazing. By the way, for such brazing connection, the plate members formed of aluminum alloy forming the heat transmission tubes 2, 2 are each structured such that brazing material is cladded on the surface thereof which provides one surface of the core material thereof and, in a state where the heat transmission tubes 2, 2 are formed, is situated on the outer peripheral surface side of the heat transmission tube 2. Also, each of the aluminum-alloy-made plate members is structured such that a sacrifice corrosion layer formed of aluminum alloy having a higher content of Zn than aluminum alloy forming the core material is coated on the surface thereof which provides the other surface of the core material thereof and, in a state where the heat transmission tubes 2, 2 are formed, is situated on the inner peripheral surface side of the heat transmission tube 2, thereby preventing the pitting from progressing on and from the inner surface side of each of the heat transmission tube 2, 2.

Figure 4:
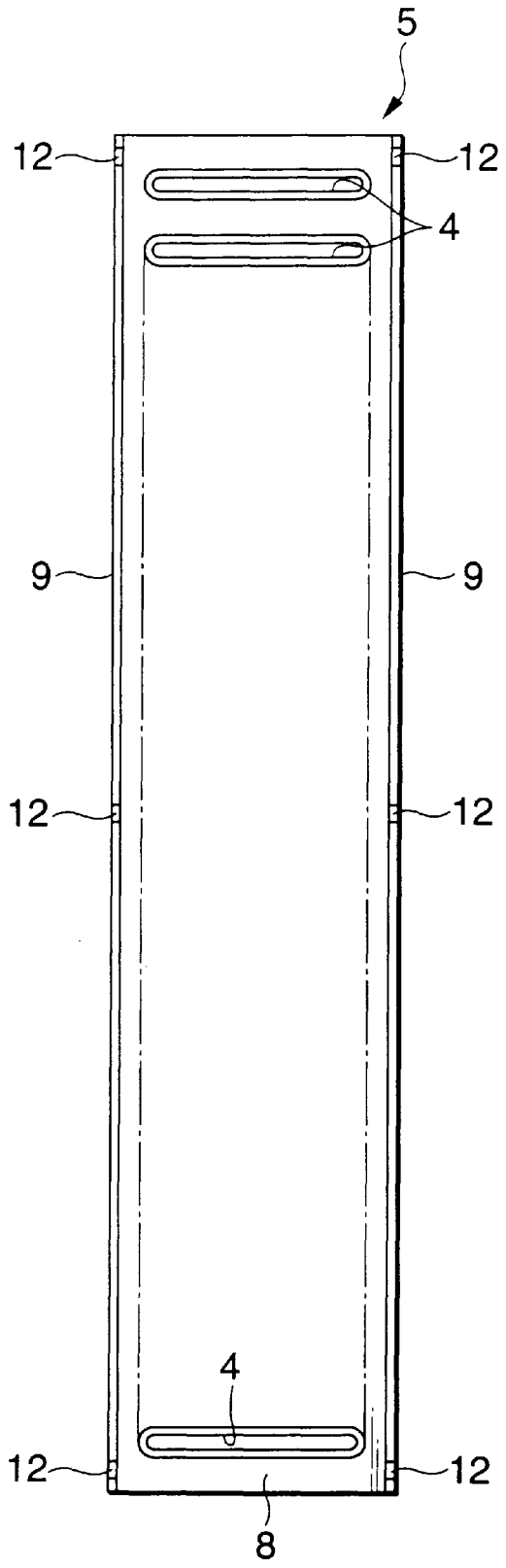
FIG. 4 is a view of a seat plate forming the left side tank in FIG. 1, when it is viewed from the left in FIG. 1.
Figure 5:
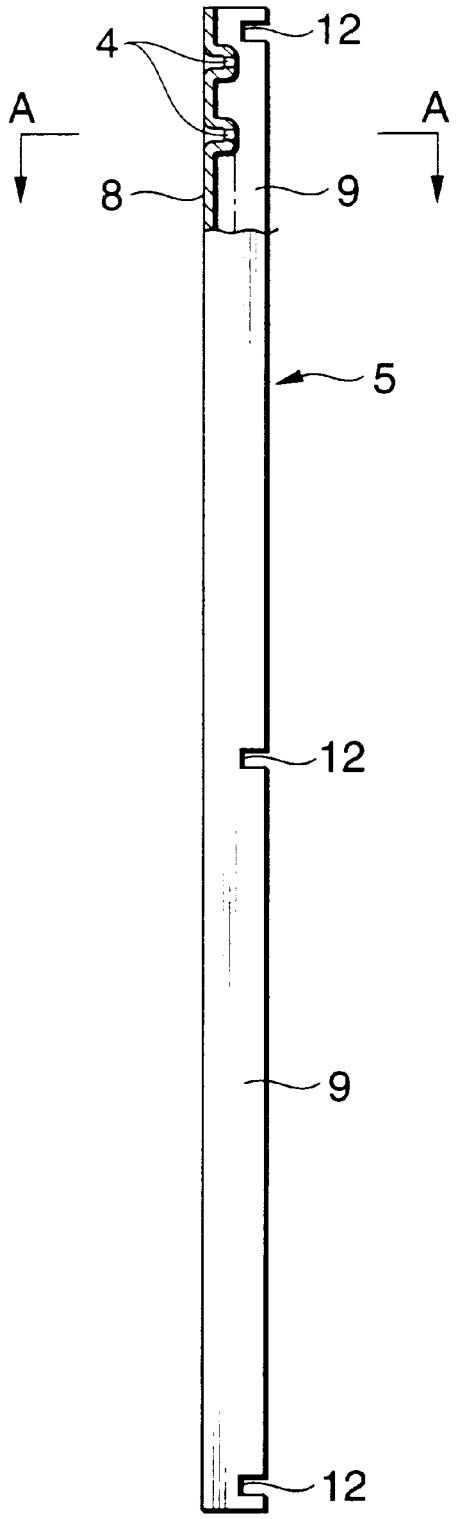
FIG. 5 is a partially cut front view of the above seat plate, when it is viewed from the left in FIG. 4.
Figure 6:
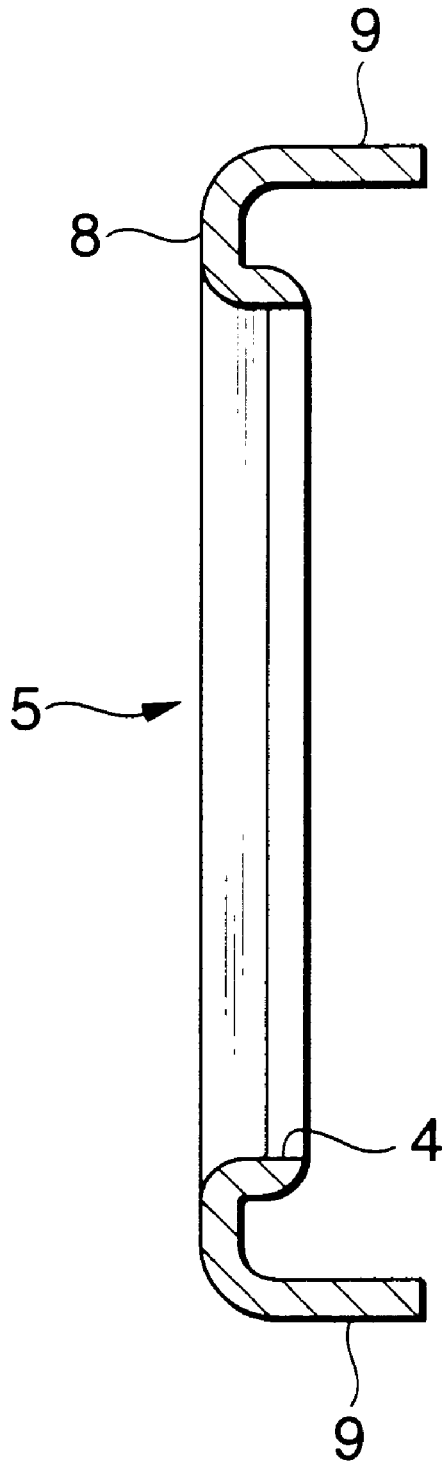
FIG. 6 is an enlarged section view taken along the line A—A shown in FIG. 5.
Figure 7:
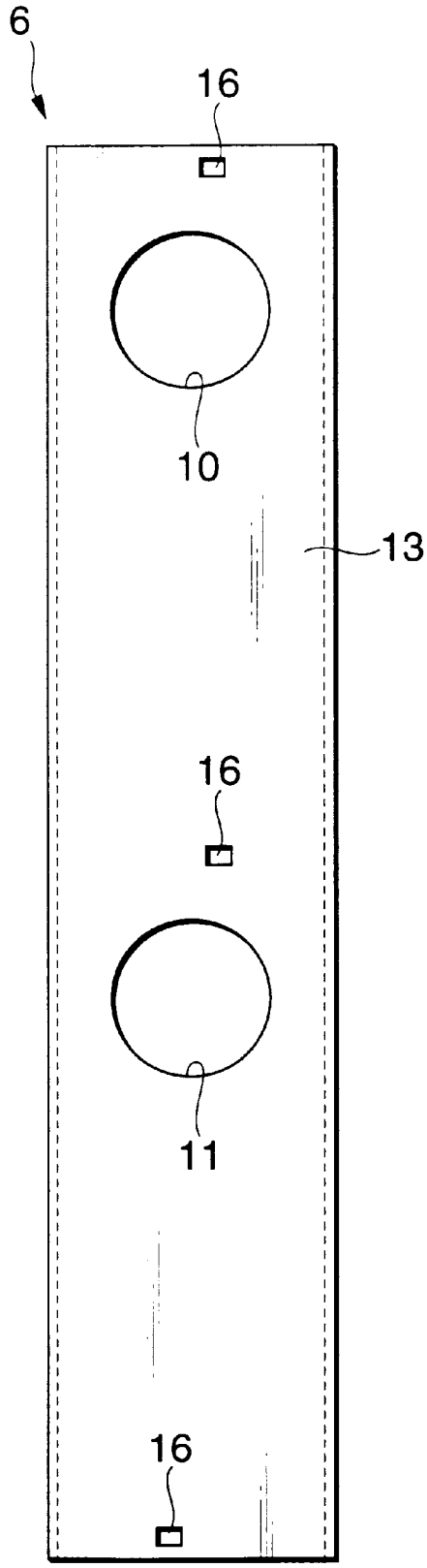
FIG. 7 is a view of a tank main body forming the left side tank shown in FIG. 1, when it is viewed from the left in FIG. 1.
Figure 8:
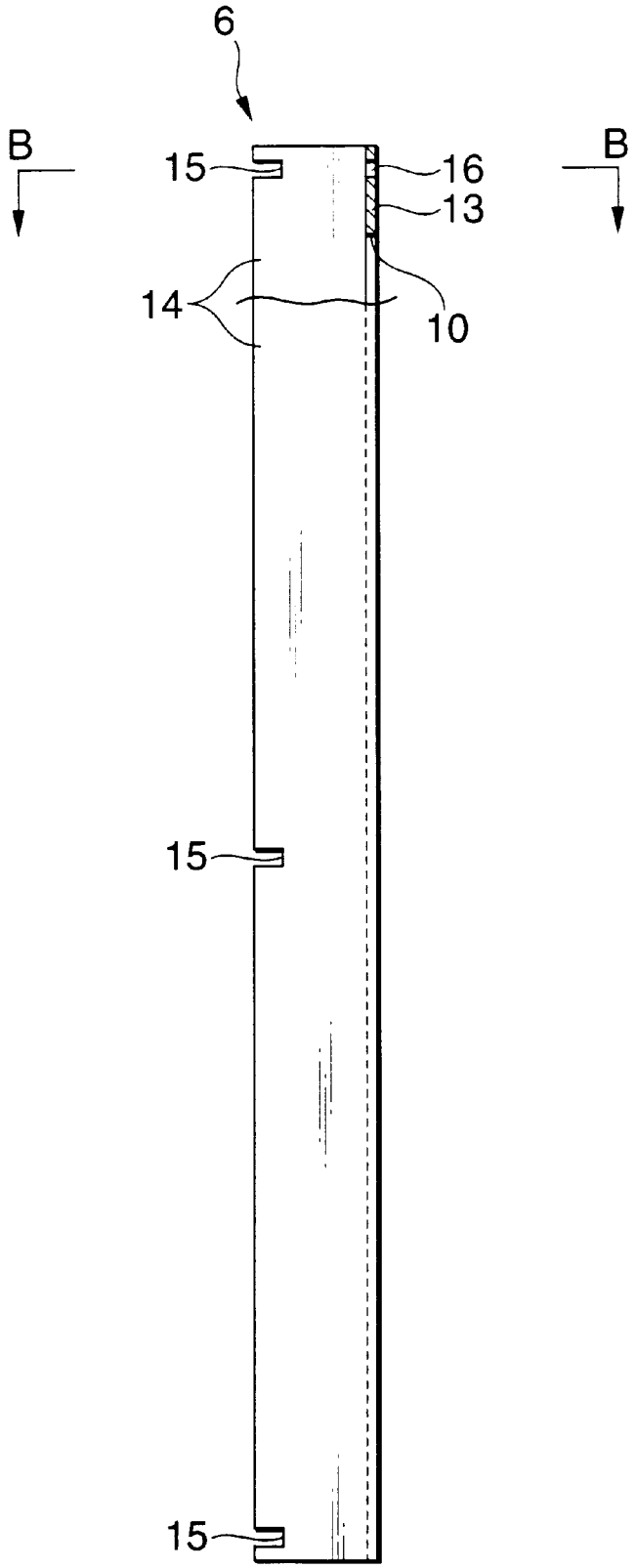
FIG. 8 is a partially cut view of the above main body when it is viewed from the left in FIG. 7.
Figure 9:
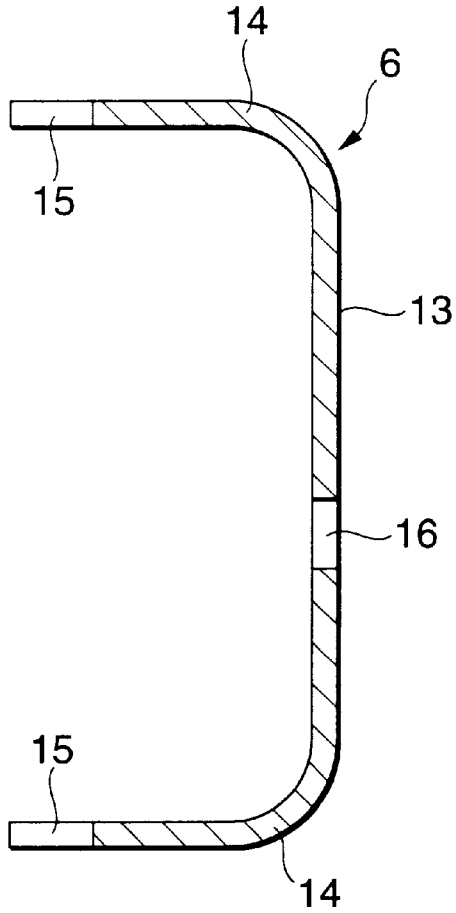
FIG. 9 is a section view taken along the line B—B shown in FIG. 8.
Figure 10:
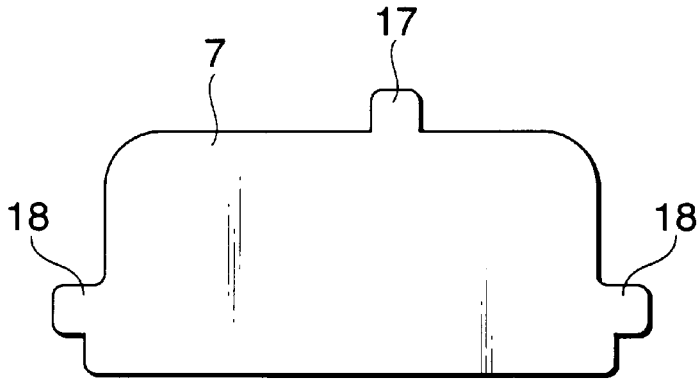
FIG. 10 is a plan view of an end plate.
Figure 11:
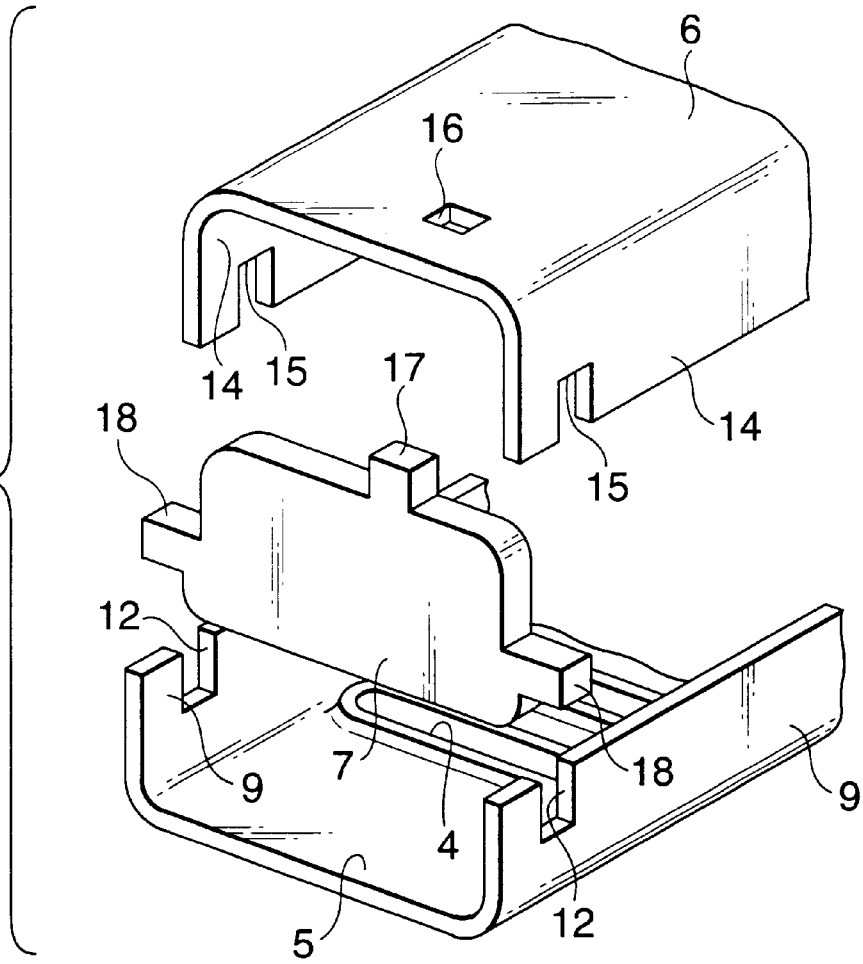
FIG. 11 is an exploded perspective view of the end portion of the above tank.

And, of the two tanks 1*a* and 1*b*, the tank 1*a*, which includes an inlet 10 and an outlet 11 respectively for feeding and discharging warm water, is composed of a seat plate 5 as shown in FIGS. 4 to 6, a tank main body 6 as shown in FIGS. 7 to 9, and two end plates 7, 7 as shown in FIG. 10. Of these component members of the tank 1*a*, the seat plate 5 is structured such that the two side edges of a base plate portion 8 of its raw plate member serving as the inner wall thereof for connection with the end portions of the end portions of the respective heat transmission tubes 2, 2 are respectively bent in the opposite direction to the arranging direction of the heat transmission tubes 2, 2 to thereby form a pair of bent wall portions 9 and 9. In the base plate portion 8 of the seat plate 5, there are formed through holes 4, 4 by burring each of which is formed in a slit shape. Also, in the portions of the two end portions and central portions of the bent wall portions 9, 9 that match each other in position in the axial direction of the bent wall portions 9, 9, there are respectively formed notches 12, 12. By the way, in the case of a seat plate 5*a* (FIGS. 1 and 2) forming the tank 1*b* in which the warm water inlet 10 and outlet 11 are not formed, only in the mutually matching positions of the two end portions of the bent wall portions 9, 9, there are formed notches 12, 12. The plate member of aluminum alloy forming the above-mentioned seat plate 5 is structured such that brazing material is cladded on the surface thereof which is one surface of the core material and, in a state where the tanks 1*a*, 1*b* are formed, is situated on the outer surface side of each of the tanks 1*a*, 1*b*. Also, on the surface of the plate member of aluminum alloy that is the other surface of the core material and, in a state where the tanks 1*a*, 1*b* are formed, is situated on the inner surface side of each of the tanks 1*a*, 1*b*, there is provided a sacrifice corrosion layer formed of aluminum alloy having a higher content of Zn than aluminum alloy forming the core material, thereby preventing the pitting from progressing on and from the inner surface side of each of the tanks 1*a* and 1*b*.

Also, the tank main body 6 is structured such that the two side edges of a top plate portion 13 of its raw plate member are bent in the arranging direction of the heat transmission tubes 2, 2 to thereby provide a pair of side plate portions 14 and 14. The respective connecting portions between the two side plate portions 14, 14 and the top plate portion 13 are set in such a manner that the radius of curvature on the inner peripheral surface side thereof is in the range of 3.5–5.5 mm, whereby, in spite of the pressure that is applied repetitively to the interior portions thereof, the respective connecting portions can be prevented against damage such as a crack and the capacities of the tanks 1*a* and 1*b* can be secured. Also, in the portions of the two end portions and central portions of the side plate portions 14, 14 that not only match each other in position in the axial direction of the tank main body 6 but also match the notches 12, 12 formed in the bent wall portions 9, 9, there are formed notches 15, 15 respectively.

Further, in the portions of the two end portions and central portions of the above top plate portion 13 that not only match each other in position in the axial direction of the top plate portion 13 but also match the above notches 12, 15, there are formed engagement holes 16, 16 respectively. The forming positions of the engagement holes 16, 16 in the top plate portion 13 in the width direction thereof are shifted to one side of the top plate portion 13 rather than the central portion thereof. In one end portion and the other portion of the top plate portion 13, the shifting directions of the engagement holes 16, 16 are opposite to each other. The engagement hole 16 formed in the central portion of the top plate portion 13 in the longitudinal direction thereof may be shifted in any direction.

By the way, in the case of the seat plate 5*a* (FIGS. 1 and 2) forming the tank 1*b* in which the warm water inlet 10 and outlet 11 are not formed and also in the case of the tank main body 6*a* (FIGS. 1 and 2), only in the mutually matching positions of the bent wall portions 9, 9, side plate portions 14, 14 and the two end portions of the bent wall portions 9, 9, there are formed the notches 12, 15 as well as the engagement holes 16, 16. The top plate portion 13 forming the tank main bodies 6, 6*a*, in a state where the tank main bodies 6, 6*a* are combined with the seat plates 5, 5*a* in a wafer-cake shaped manner, are disposed opposed to the base plate portion 8 forming the present seat plate 5, 5*a* in such a manner that they are spaced from each other. The aluminum-alloy-made plate members forming the above-structured tank main bodies 6, 6*a* are also formed such that brazing material is cladded on the surface thereof which is one surface of the core material and, in a state where the tanks 1*a*, 1*b* are formed, is situated on the outer surface side of the tanks 1*a*, 1*b* and also such that a sacrifice corrosion layer is disposed on the surface thereof which is the other surface of the core material and, in a state where the tanks 1*a*, 1*b* are formed, is situated on the inner surface side of the tanks 1*a*, 1*b*.

Also, the end plates 7, 7 are respectively structured such that, in a state where the seat plate 5 and tank main body 6 are combined together in a wafer-cake shaped manner, their respective outer peripheral edges are contacted with the entire peripheries of the inner peripheral surfaces of the tanks 1*a*, 1*b* or are disposed opposed to such entire peripheries with a very slight clearance between them. That is, the outer peripheral edges of the end plates 7, 7 are contacted with or are adjacently disposed opposed to the inner surfaces of the base plate portion 8 forming the seat plates 5, 5*a* and bent wall portions 9, 9 as well as the inner surfaces of the top plate portion 13 forming the tank main body 6, 6*a* and side plate portions 14, 14. In the portions of part of the peripheral edge portions of the end plates 7, 7 that are disposed opposed to the top plate portion 13, there are formed engagement projecting pieces 17 which can be engaged with the engagement holes 16 with a small clearance between them. The forming positions of the engagement projecting pieces 17 are shifted from the central portions of the end plates 7, 7 so as to match the forming positions of the engagement holes 16.

Therefore, in case where, while the engagement holes 16 are engaged with the engagement projecting pieces 17 respectively, the seat plates 5, 5*a* are combined with the tank main bodies 5, 5*a* to thereby form the tanks 1*a*, 1*b*, a direction, in which the front and back surfaces of the end plates 7, 7 are assembled to the tanks 1*a*, 1*b*, can be defined in an only-one-meaning manner. The end plates 7, 7 are also structured such that brazing material is cladded on one surface of the core material and a sacrifice corrosion layer is disposed on the other surface of the core material. The forming positions of the engagement holes 16 and engagement projecting pieces 17 are set such that the brazing material is situated on the outer surface side of the tanks 1*a*, 1*b* and the sacrifice corrosion layer is situated on the inner surface side thereof.

Also, in the illustrated embodiment, on the two side edges of the end plates 7, 7 that match the notches 12, 15 formed respectively in the bent wall portions 9, 9 of the seat plates 5, 5*a* and in the side plate portions 14, 14 of the tank main bodies 6, 6*a*, there are provided projecting pieces 18, 18. Inastate where the seat plate 5 and tank main body 6 are combined together in a wafer-cake shaped manner while holding the end plates 7, 7, the leading end portions of the projecting pieces 18 are respectively projected through the notches 12, 15 from the tanks 1*a* and 1*b* which are formed by the bent wall portions 9, 9 and side plate portions 14, 14. The leading end portions of the projecting pieces 18 which project from the outer surfaces of the tanks 1*a* and 1*b*, prior to a heating step in which brazing is executed, are deformed plastically because they are collapsed by pressing to thereby make their width dimensions larger than the width dimensions of the notches 12, 15. In this state, the leading end portions of the projecting pieces 18 are unable to pass through the notches 12, 15, so that the bent wall portions 9, 9 and side plate portions 14, 14 are prevented from shifting in their mutually opposite directions. Therefore, even when the seat plates 5, 5*a* and tank main bodies 6, 6*a* are softened due to heating for brazing, the bent wall portions 9, 9 and side plate portions 14, 14 forming the fitting portions between the seat plates 5, 5*a* and tank main bodies 6, 6*a* are left contacted with each other, so that the bent wall portions 9, 9 and side plate portions 14, 14 can be brazed together properly.

The above-mentioned component members are combined in such a state as shown in FIGS. 1 to 3 and are provisionally fixed by a jig (not shown), in this provisionally fixed state, the component members are heated in a heating furnace to braze and fix the mutually adjoining components members, thereby producing an aluminum-alloy heat exchanger. The thus produced aluminum-alloy heat exchanger is incorporated into a heat unit forming an air conditioning apparatus for a car, and the downstream end of a warm-water feeding pipe is connected to the inlet 10 formed in one tank 1*a*, while the upstream end of a warm-water discharging pipe is connected to the outlet 11 of the tank 1*a*. Warm water, which is poured from the inlet 10 into an entrance chamber 19 formed in one half section of the tank 1*a*, is sent to the other tank 1*b* through one half of the plurality of heat transmission tubes 2, 2. And, the warm water is reversed within the tank 1*b* and is sent through the remaining half of the heat transmission tubes 2, 2 into an exit chamber 20 formed in the other end portion of the tank 1*a* and, after then, the warm water is discharged from the exit chamber 20 through the outlet 11 into the discharging pipe.

According to the aluminum-alloy heat exchanger of the invention that is structured and operates in the above-mentioned manner, the tank main bodies 6, 6*a* and seat plates 5, 5*a* forming the tanks 1*a*, 1*b* are easy to work, and the brazing material cladded on one surface of each of the end plates 7, 7 can be positively positioned on the outer surface side of the tanks 1*a*, 1*b*. That is, since the tank main bodies 6, 6*a* and seat plates 5, 5*a* respectively have shapes which can be bent with a small force, they can be manufactured easily by a press having a small capacity or by a roll forming machine. In any case, it is possible to produce easily blank members which are longer than the tank main bodies 6, 6*a* and seat plates 5, 5*a* that are actually used. The tank main bodies 6, 6*a* and seat plates 5, 5*a* can be used after they are produced by cutting their long blank members to a desired length. Therefore, when manufacturing aluminum-alloy heat exchangers having different width dimensions, simply by changing the cut length of the blank members, they can be manufactured easily.

Also, the component members 5, 5*a*, 6, 6*a* of the tanks 1*a*, 1*b* are respectively so called clad members in which brazing material is cladded on one surface thereof and, in each of them, the brazing material is present on the outer surface side of the tanks 1*a*, 1*b*. Therefore, the presence of the brazing material can effectively prevent the corrosion (pitting) from progressing on and from the inner surface side of the tanks 1*a*, 1*b*. This makes it possible to realize an aluminum-alloy heat exchanger which not only has sufficient durability but also does not increase the cost of the facilities for working the component members and thus can be manufactured at a low cost. By the way, in the central portion of one tank 1*a* where the inlet 10 and outlet 11 are formed, there is provided an end plate 7 which is similar to the end plates 7, 7 provided in the two end openings, thereby dividing the interior portion of the tank 1*a* into the entrance chamber 19 and exit chamber 20. Therefore, the end plate 7 provided in the central portion of one tank 1*a* functions as a partition plate. Since brazing material is present on one surface of the end plate 7 functioning as a partition plate, it is assumed that, in the end plate 7, pitting can progress on and from such one surface side thereof. However, even when there is formed a small pore due to the pitting in this manner in the end plate 7 serving as a partition plate, since such small pore does not lead to a water leakage failure, this seldom raises any problem.

Figure 12:
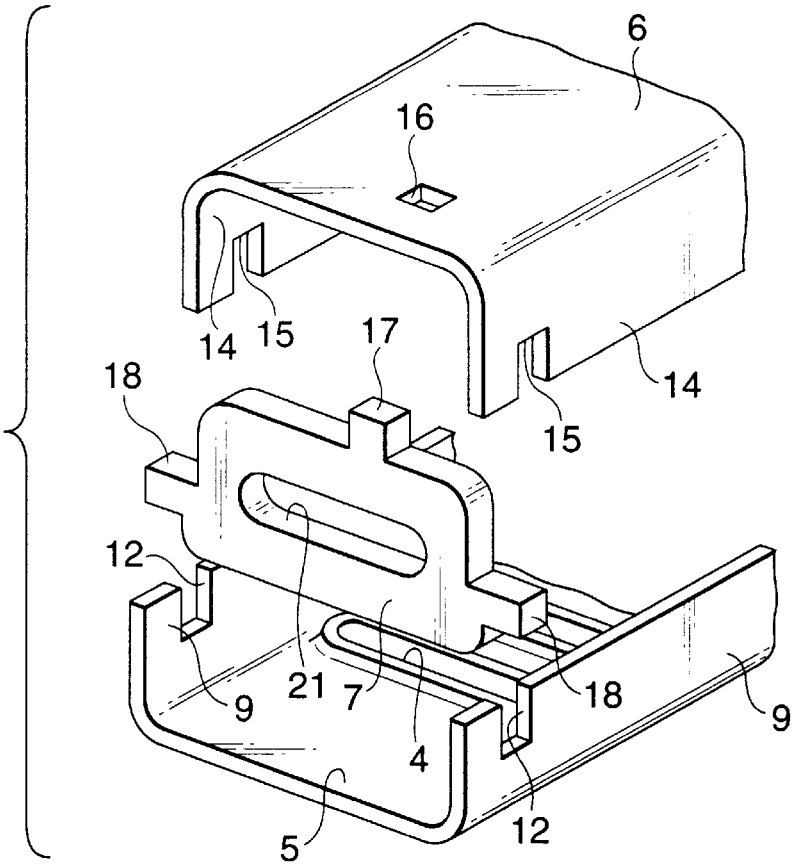
FIG. 12 is an exploded perspective view of the end portion of a tank employed in a second embodiment according to the invention.
Figure 13:
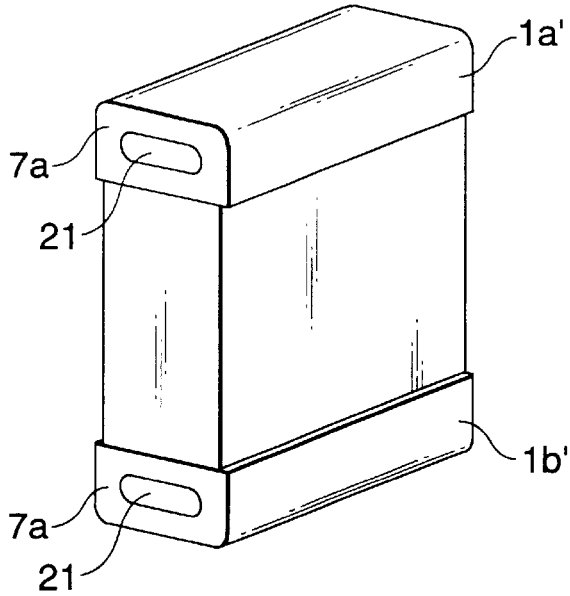
FIG. 13 is a substantially perspective view of an aluminum-alloy heat exchanger, showing a state thereof in which it is assembled as the aluminum-alloy heat exchanger.

Next, FIGS. 12 and 13 respectively show a second embodiment of an aluminum-alloy heat exchanger of the invention. In this embodiment, in the central portions of end plates 7*a*, 7*a* which are respectively used to close the one-end-side openings of tanks 1*a*', 1*b*', there are formed through holes 21, 21 respectively. The other-end-side openings of the tanks 1*a*', 1*b*', similarly to the previously described first embodiment, are closed by end faces having no holes. Also, in the case of the tanks 1*a*', 1*b*', in the intermediate portions thereof, there is disposed no partition plate.

In the case of the structure of the present embodiment, of the through holes 21, 21 respectively formed in the end plates 7*a*, 7*a*, one through hole 21 is connected to the downstream end of a water feeding pipe and the other through hole 21 is connected to the upstream end of a water discharging pipe. Warm water, which is fed into the interior portion of one tank 1*a*' from the discharging pipe, flows through the all of the heat transmission tubes toward the other tank 1*b*' and, after then, it is discharged into a discharging pipe. In the structure according to the present embodiment, the arranging direction of the feeding pipe and discharging pipe is different from the direction employed in the previously described first embodiment, which can contribute to the enhancement of the freedom of the design of an air conditioning apparatus for a car. Of course, the structure according to the present embodiment in which the end portion of a pipe for passing the warm water is connected to the end face of a tank can also be combined with the structure according to the first embodiment in which the end portion of a pipe for passing the warm water is connected to the intermediate portion of a tank.

Since the present invention is structured and operates in the above-mentioned manner, it is able to realize an aluminum-alloy heat exchanger which has excellent durability and can be manufactured at a low cost.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. An aluminum-alloy heat exchanger comprising:

a pair of tanks being disposed spaced from each other;

a plurality of heat transmission tubes, two end openings of each of heat transmission tubes communicating with an interior portion of said tanks; and a plurality of fins being respectively interposed between the mutually adjoining ones of said heat transmission tubes, wherein said tank comprises:

a seat plate comprising aluminum alloy, said seat plate having a first base portion and first side walls formed on side edges of the first base portion;

a tank main body comprising aluminum alloy, said tank body having a second base portion and second side walls formed on side edges of the second base portion; and two end plates comprising aluminum alloy, said first side walls and said second side walls being connected and a peripheral edge of said end plate being contacted with inner surfaces of said first and second side walls and first and second base portions, wherein an engagement projecting piece is formed on a part of the peripheral edge of said end plate, an engagement hole is formed in said second base portion so as to be engaged with the engagement projecting piece, and said engagement projecting piece and said engagement hole are formed at positions shifted from a central portion of said tank in a width direction thereof to thereby define an assembling direction of front and back surfaces of said end plates with respect to said tanks in an only one way manner.

2. An aluminum-alloy heat exchanger according to claim 1, wherein said end plate is a clad member comprising:

a core material made of a first aluminum alloy; and a brazing material made of a second aluminum alloy having a lower melting point than that of the first aluminum alloy and coated on a first surface of said core material, and wherein said end plate is held by and between said seat plates and tank main body, and said brazing material is present on an outer surface side of said tank.

3. An aluminum-alloy heat exchanger according to claim 2, wherein a sacrifice corrosion layer is disposed on a second surface of said core material of said end plate, said sacrifice corrosion layer having a higher Zn content than that of said core material.

4. An aluminum-alloy heat exchanger according to claim 1, wherein notches are formed at end edges of first and second side walls at mutually matching positions, and said end plate having a projecting piece which projects from said seat plate and said tank main body through the notch and is deformed to thereby said seat plate and said tank main body from separating with each other.

5. An aluminum-alloy heat exchanger according to claim 1, wherein a through hole through which a fluid is fed or discharged is formed in said end plate.

6. A tank for an aluminum-alloy heat exchanger, comprising:

a seat plate comprising aluminum alloy, said seat plate having a first base portion and first side walls formed on side edges of the first base portion;

a tank main body comprising aluminum alloy, said tank body having a second base portion and second side walls formed on side edges of the second base portion; and an end plate comprising aluminum alloy, said first side walls and said second side walls are connected and a peripheral edge of said end plate being contacted with inner surfaces of said first and second side walls and first and second base portions, wherein an engagement projecting piece is formed on a part of the peripheral edge of said end plate, an engagement hole is formed in said second base portion so as to be engaged with the engagement projecting piece, and said engagement projecting piece and said engagement hole are formed at positions shifted from a central portion of said tank in a width direction thereof to thereby define an assembling direction of front and back surfaces of said end plate with respect to said tank in an only one way manner.

7. A tank for an aluminum-alloy heat exchanger according to claim 6, wherein said end plate is a clad member comprising:

a core material made of a first aluminum alloy; and a brazing material made of a second aluminum alloy having a lower melting point than that of the first aluminum alloy and coated on a first surface of said core material, and wherein said end plate is held by and between said seat plates and tank main body, and said brazing material is present on an outer surface side of said tank.

8. A tank for an aluminum-alloy heat exchanger according to claim 7, wherein a sacrifice corrosion layer is disposed on a second surface of said core material of said end plate, said sacrifice corrosion layer having a higher Zn content than that of said core material.

9. A tank for an aluminum-alloy heat exchanger according to claim 6, wherein notches are formed at end edges of first and second side walls at mutually matching positions, and said end plate having a projecting piece which projects from said seat plate and said tank main body through the notch and is deformed to thereby said seat plate and said tank main body from separating with each other.

10. A tank for an aluminum-alloy heat exchanger according to claim 6, wherein a through hole through which a fluid is fed or discharged is formed in said end plate.

* * * * *